US005727514A

United States Patent [19]

Sunden

[11] Patent Number: 5,727,514

[45] Date of Patent: Mar. 17, 1998

[54] REMOTE CONTROLLED INTERMITTENT USER ACTIVATED ANTI-CORROSION FOGGING DEVICE FOR INFREQUENTLY USED INTERNAL COMBUSTION MARINE ENGINES

[76] Inventor: Carl Sunden, 894 Aberdeen Rd., West Bay Shore, N.Y. 11706

[21] Appl. No.: 554,905

[22] Filed: Nov. 9, 1995

[51] Int. Cl.[6] ..... F02M 1/16

[52] U.S. Cl. ..... 123/198 A; 123/6.26

[58] Field of Search ..... 123/196 S, 198 E, 123/196 M, 198 A; 184/6.5, 6.8, 6.26

[56] References Cited

U.S. PATENT DOCUMENTS

| | | | |
|---|---|---|---|
| 1,824,560 | 9/1931 | Gronkwist | 285/296 |
| 1,967,251 | 7/1934 | McFerren | 184/6 |
| 2,334,942 | 11/1943 | Malone | 184/7 |
| 3,481,317 | 12/1969 | Hughes | 123/143 |
| 4,199,950 | 4/1980 | Hakanson | 60/605 |
| 4,359,140 | 11/1982 | Shreve | 184/6.3 |
| 4,403,578 | 9/1983 | Iwai | 123/73 AD |
| 4,524,734 | 6/1985 | Miller | 123/196 S |
| 4,692,123 | 9/1987 | Tada | 440/77 |
| 4,807,578 | 2/1989 | Adams et al. | 123/198 A |
| 4,998,969 | 3/1991 | Bowers et al. | 123/198 A |
| 5,022,364 | 6/1991 | Phillips | 123/198 A |
| 5,149,287 | 9/1992 | Koike | 440/88 |
| 5,197,424 | 3/1993 | Blum | 123/196 S |
| 5,327,861 | 7/1994 | Rogalla | 123/196 S |
| 5,353,761 | 10/1994 | Kalishman | 123/198 A |
| 5,375,572 | 12/1994 | Bowden | 123/196 S |
| 5,375,573 | 12/1994 | Bowman | 123/196 R |
| 5,452,696 | 9/1995 | Flynn | 123/198 A |
| 5,503,683 | 4/1996 | Butcher et al. | 123/198 A |
| 5,542,498 | 8/1996 | Boelkins | 184/6.26 |

OTHER PUBLICATIONS

Marvel Inverse Oiler, Advertisement, Marvel Oil Company, Inc., Port Chester, NY, Jan. 1994.

Outboard Marine Corporation, Advertisement, SysteM-atched Division, Beloit, WI 53511, Jun., 1990.

*Primary Examiner*—David A. Okonsky

*Attorney, Agent, or Firm*—Alfred M. Walker

[57] ABSTRACT

An anti-corrosion fogging device for internal combustion engines, such as marine engines, includes a system which injects oil having anti-corrosive properties into the engine of a boat. The device may be applied to two cycle outboard motors as well as four cycle engines. The system dispenses the anti-corrosive oil by means of an aerosol spray can permanently connected to a remotely controlled solenoid valve which through a hose supplies oil to a spray nozzle permanently installed on the engine. A user can at will dispense a controllable quantity of anti-corrosive oil into an internal combustion engine at the end of an operating cycle to protect the engine against corrosion during prolonged idleness.

17 Claims, 2 Drawing Sheets

REMOTE CONTROLLED INTERMITTENT USER ACTIVATED ANTI-CORROSION FOGGING DEVICE FOR INFREQUENTLY USED INTERNAL COMBUSTION MARINE ENGINES

FIELD OF THE INVENTION

The present invention is directed to a convenient, user activated fogging device for application of anti-corrosive oils within internal combustion engines, which are used infrequently, such as marine engines which may sit idle for extended periods of time between uses.

BACKGROUND OF THE INVENTION

It is common procedure to "fog" an internal combustion engine, such as a marine engine with anti-corrosive oil once at the end of the season to provide corrosion protection during winter lay up. However, such a "fogging" procedure requires partial dismantling of a marine engine's intake, which is a time consuming process.

Among prior art patents for engine lubricating systems include U.S. Pat. No. 5,149,287 of Koike which shows an auxiliary lubricating system for 2 cycle outboard motors for boats, which require an oil-gas mixture for fuel. Therefore, the Koike system is inapplicable for 4 cycle engines, which only consume gasoline.

U.S. Pat. No. 5,375,572 of Bowden discloses a storage insert for holding lubricant and desiccant to protect an internal combustion engine during extended periods of storage non-use. However, the storage insert of Bowden is designed to be used only once per season.

U.S. Pat. No. 1,824,540 of Gronkwist discloses an apparatus for producing a lubricating oil mist.

U.S. Pat. No. 5,327,861 of Rogalla discloses an automatic oil additive injector and oil additive reservoir incorporated in the lubricating oil filter head. Silicone fluid is automatically added during oil drainage. The device of Rogalla is primarily used for the crank case.

U.S. Pat. No. 4,359,140 of Shreve discloses an engine auxiliary oiler for use in pre-lubricating the oil before starting an engine.

U.S. Pat. No. 5,197,424 of Blum describes a pre-lubrication system for engines which includes a solenoid valve for selective opening of the valve, to inject rapidly a lubricant into the oil pump, but not into the cylinders through the manifold. The device in Blum lets pressurized oil out of the oil pump.

Similar in concept to Koike, U.S. Pat. No. 4,403,578 of Iwai describes a separate lubricating system for 2 cycle outboard motors, wherein an oil-gas mixture is consumed by the engine.

U.S. Pat. No. 4,524,734 of Miller and U.S. Pat. No. 4,199,950 of Hakanson both discloses auxiliary pressurized lubricating systems for engines for pressurizing the oil before starting up the engine.

U.S. Pat. No. 2,334,942 of Malone describes an oil misting system. U.S. Pat. Nos. 1,967,251 of McFerren and 2,324,116 of Sivertsen disclose lubricating systems in general. U.S. Pat. No. 4,692,123 of Tada discloses a 2 cycle outboard engine in general, which requires an oil-gasoline mixture.

A continuous flow oil lubrication system for engines is manufactured under the trade name of Marvel Inverse Oiler of Marvel Oil Company, Port Chester, N.Y. In the Marvel device, oil is continuously fed to an engine under use. The Marvel device is intake manifold vacuum activated, and automatically adjusts the proper rate of oil feed to an operating engine. The oil is metered out in proportion to engine load.

Moreover, OMC (Outboard Marine Corporation) in its "Systematched" accessory division, manufactures an aerosol dispenser for storage fogging oil, which is applied manually directly to a two cycle outboard engine. Such a manually operated device would not be practical for an inboard marine engine without physically opening the engine hatch, entering the engine compartment and removing the flame arrester to gain access to the engine interior to manually spray the fogging spray into the inboard engine.

However, in general, the prior art patents only provide lubricating mechanisms in general, generally to pressurize oil before using an engine. The prior art patents do not combine the concept of a separate remotely controlled, permanently installed injection system of anti-corrosion oil for internal combustion engines, such as four cycle inboard marine engines.

SUMMARY OF THE INVENTION

The present invention pertains to an anti-corrosion fogging device for internal combustion engines, such as marine engines or other infrequently used engines, such as in antique motor vehicles or seasonal use recreational mobiles. The anti-corrosion fogging device comprises a remotely controlled user activated system which injects anti-corrosive oil into the engine at the end of the engine's operating cycle.

The anti-corrosive oil is a light weight mineral oil with anti-corrosive additives. One example of such an anti-corrosive oil is sold under the brand name of Marvel Mystery Oil® of Marvel Oil Company, Inc. of Port Chester, N.Y.

The device may be applied to two cycle outboard motors as well as four cycle engines.

The present invention dispenses the anti-corrosive oil by means of a reservoir, such as an aerosol spray can substantially permanently connected to a solenoid controlled valve, which is controlled remotely by a hand operated switch. Another alternative is by a pump, which is connected to a container of anti-corrosive oil.

A user can, at will, dispense a controllable quantity of anti-corrosive oil into an internal combustion engine, so that corrosion does not start and damage the engine between infrequent uses.

For example, a boat may sit idle at a mooring in the water for several weeks between uses. The user can also periodically apply anti-corrosive oil into antique motor vehicle engines or seasonal recreational vehicles, such as warm weather all terrain vehicles or cold weather snowmobiles.

In the preferred embodiment, marine engines are particularly susceptible to corrosion damage, due to the humid environment within a marine engine of a pleasure boat, which often is idle for prolonged periods between usage. Due to the water cooled exhaust system, high humidity and water may enter the engine and do corrosion damage.

While daily use of an inboard marine engine helps keep the engine from corroding by constant exposure to boat motor oil, for the occasional sailor the duration of time between uses when a boat engine is idle causes humidity to build up in the engine, which accelerates corrosion.

To combat corrosion during winter non-use, it is known to "fog" out a marine engine by opening the engine and pouring special anti-corrosion oils directly into the engine while the engine is idling fast.

However, this method has the disadvantage that the engine must be opened up, which is a time consuming procedure.

This method also has the disadvantage that it is done only once at the end of a boating season before winter, and therefore does not protect the engine for one or two week intervals during the boating season when humidity builds up within the interior of the motor. The same situation applies to antique motor vehicle engines which may sit idle in a garage between uses or to recreational vehicles which are used infrequently during specific seasons of the year.

It is also known that two cycle outboard motors may have oil injection accessories, however, these accessories are primarily for the purpose of contributing to the fuel-oil mixture required in two cycle engines.

For inboard four cycle engines which do not burn a fuel-oil mix, but rather only fuel, there is no known method of injecting oil, especially anti-corrosive oil, into the motor by user activated remote control.

Therefore the present invention proposes an auxiliary oil injector, for directly injecting a controllable quantity of anti-corrosive oil, depending upon engine size, into the engine at the end of each day after a boat is used, if the user believes the boat may sit idle for some time. As a result thereof, a boat user can fog out the motor each time the boat is used.

Injecting of the anti-corrosive oil may be by an aerosol spray can substantially permanently connected to the engine. The aerosol spray can is controlled by a remotely controlled solenoid, or by a pump connected to a container of anti-corrosive oil, also substantially permanently connected to the engine.

With the use of the present invention, a user can, by remote control, inject a controllable quantity of anti-corrosive oil into internal combustion engines, such as a marine engine, between uses, so that corrosion does not build up and damage the marine engine between uses.

DESCRIPTION OF THE DRAWINGS

The present invention can best be understood in conjunction with the accompanying drawings, in which.

DETAILED DESCRIPTION OF THE PREFERRED EMBODIMENTS

Figure 1:
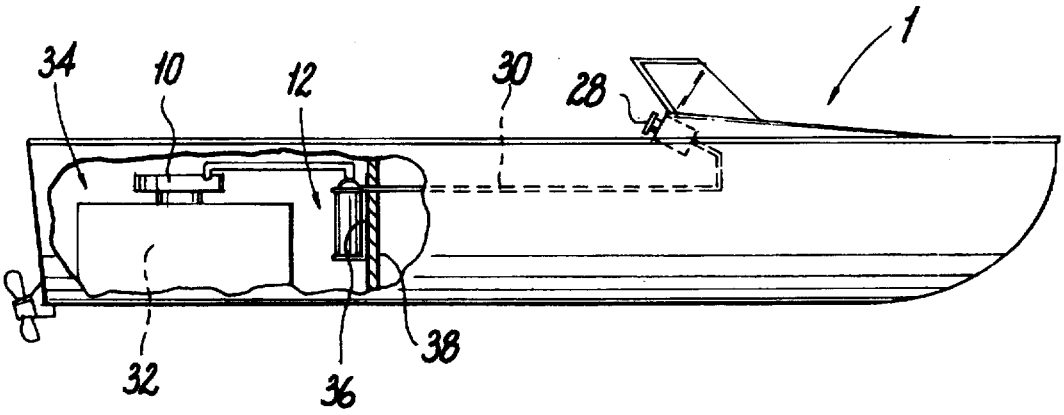
FIG. 1 is a side elevational view of a typical boat installation for a remote controlled marine engine fogger of the present invention.
Figure 2:
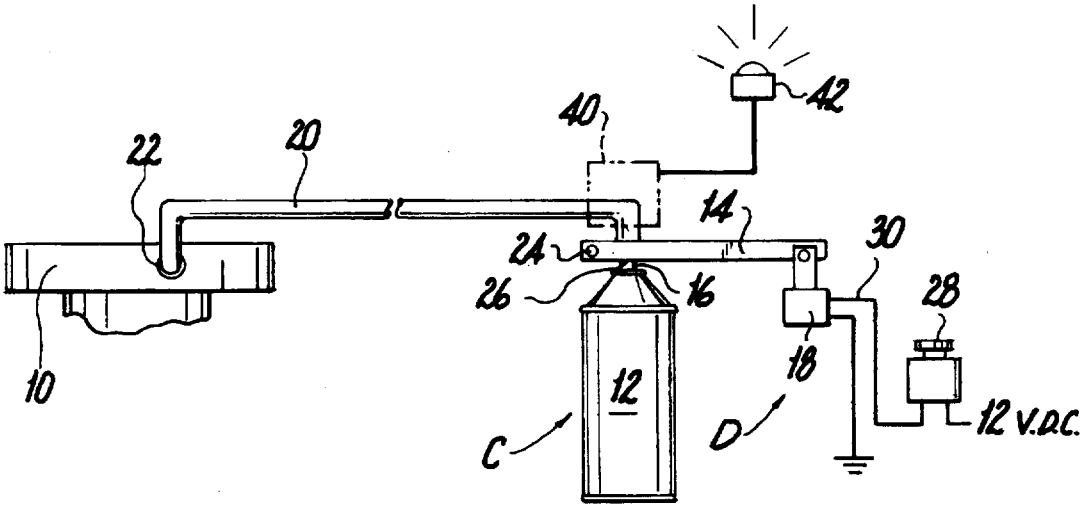
FIG. 2 is a system diagram of the remote controlled marine engine fogger as in FIG. 1.
Figure 3:
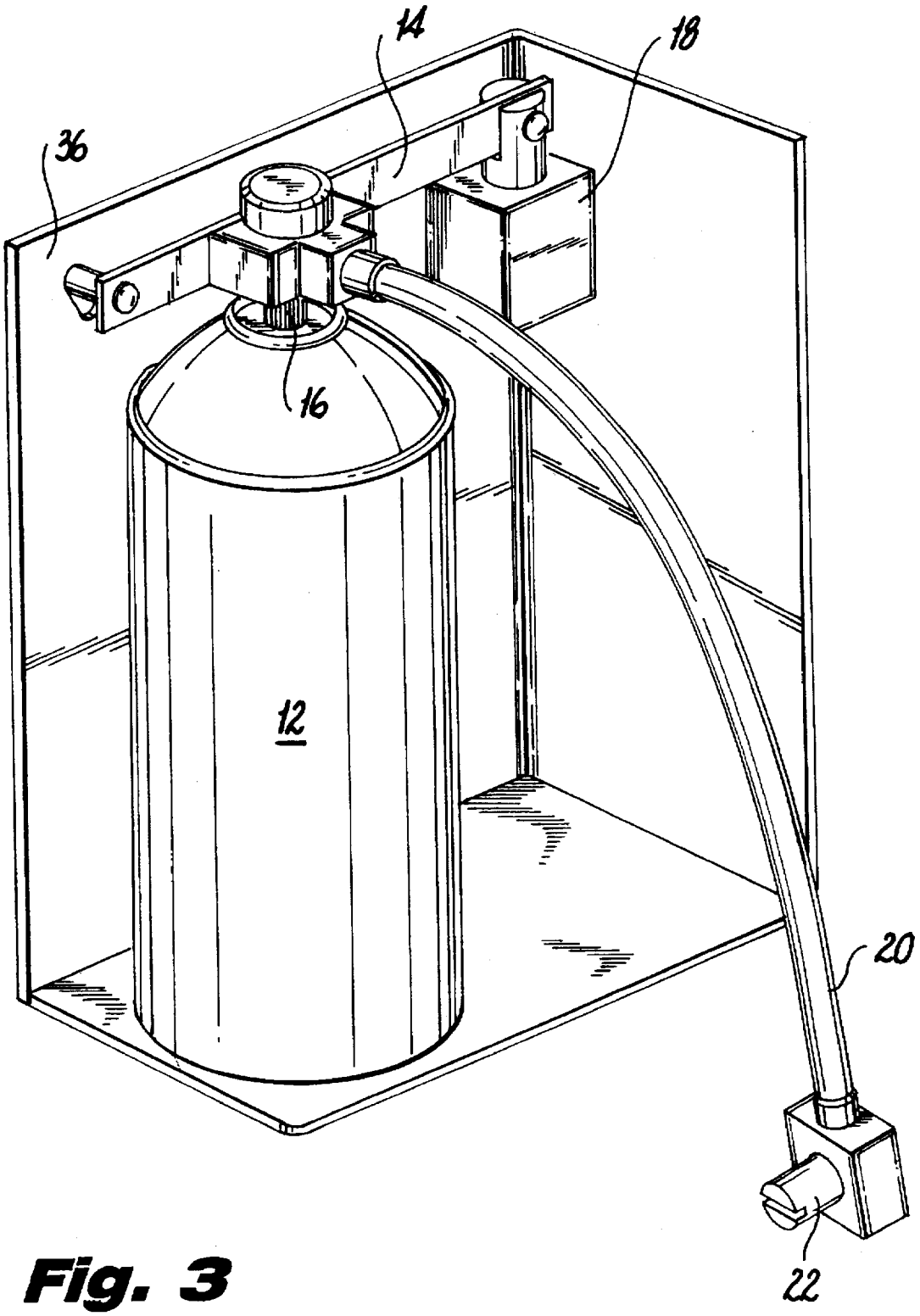
FIG. 3 is a close up view of the remote controlled marine engine fogger as in FIG. 1.

According to the present invention, a dispenser, such as, for example, an aerosol spray can 12 contains anti-corrosive oil to coat and protect the internal engine components of an internal combustion engine, such as a marine engine, before extended idle periods of use. The anti-corrosive oil suppresses corrosion of the engine interior of boat 1.

In general, intermittent use dispensers may include aerosol spray can 12, as well as electric pumps, hydraulic pumps or vacuum activated pumps, as long as the dispenser is capable of moving a fluid therethrough.

The aerosol spray can 12 used in the present invention preferably is activated by a lever 14 mounted on an outlet valve 16 of the aerosol spray can 12. The anti-corrosive oil consists essentially of a generally light weight mineral oil with special corrosive inhibiting additives. A 12V power supply provides power to a solenoid 18 to selectively dispense anti-corrosive oil therefrom through a hose 20 having spray nozzle 22 substantially permanently attached to marine engine intake 10. The user can at will spray the anti-corrosive oil from aerosol spray can 12 through hose 20 and spray nozzle 22 into engine intake 10.

In a preferred embodiment, lever 14 is pulled down by a remotely controlled activated force means, such as a solenoid switch or other means against outlet valve 16, thereby releasing pressure within outlet valve 16, to permit the flow of the anti-corrosive material through spray nozzle 22 into engine intake 10.

In operation, lever 14 has a preferable approximate 3:1 ratio of the length of lever 14 when compared to the distance from pivot point 24 to the point of contact 26 of lever 14 at outlet valve 16.

Lever 14 is operated when a user at will depresses activation button 28 connected by connector 30 to a remote activator, such as preferably solenoid 18, or other remote activators, such as hydraulic, hydropneumatic or mechanical activators. Low 12V power is supplied to solenoid 18 to pull lever 14 downward in the direction of solenoid 18, about pivot point 24. The 3:1 ratio is ideal to reduce the size of the solenoid 18 for causing outlet valve 16 to open to permit the flow of anti-corrosive oil therethrough.

In the present invention, the interior 32 of engine 34 is treated against corrosion by pressured flow of anti-corrosive fuel to engine intake 10. The user of the boat can apply the fogging anti-corrosive material at will, within the engine 34.

Optionally, pressure sensitive switch 40 may be applied to hose 20 to ascertain when aerosol spray can 12 is almost empty, and needs to be replaced. Pressure sensitive switch is attached to a discernable signal alarm 42, such as an alarm light button or a sound emitting alarm.

Application of the anti-corrosive oil spray is carried out after the conclusion of a boat outing, so that the anti-corrosive materials can work to prevent corrosion within engine 34.

Lever 14 of the aerosol spray can 12 may be designed in any shape including a rod-line shape, or solenoid 18 can be directly applied above outlet valve 16.

The mounting base 36 for the aerosol spray can 12 and solenoid 18 may be designed in any shape for attachment to bulkhead wall 38 of boat 1. Placing solenoid 18 to the side of aerosol can 12 reduces the height of the device, and makes the unit compact for installation in tight quarters within boat 1.

Factors which influence the quantity of the fogging oil within engine 34 vary according to the type of engine and the duration of idleness of boat 1 within water.

The amount of fogging oil injected into engine 34 is controlled by depression of activation button 28 for a controllable period of time, depending upon the given discharge rate of the fogging oil through outlet valve 16. Therefore, the quantity of fogging oil depends upon the length of time which activation button 28 is depressed. It is also anticipated that other discharge flow control mechanisms may be employed, wherein activation button 28 is automatically depressed for a controllable amount of time.

It is also noted that since aerosol spray can 12 may lose pressure after considerable use, therefore it is possible to compensate for the pressure loss by holding activation button 28 down for a longer period of time.

It is preferable to spray in such manner that the fogging oil within engine 34 is an amount of sufficient quantity to coat the inside of the cylinders of the engine and on the pistons and/or internal components therein.

It is noted that other modifications may be made to the remote activator of the present invention, such as substituting hydraulic controls, hydropneumatic controls or mechanical cables instead of electrical solenoid 18, to activate outlet valve 16 of aerosol spray can 12, without departing from the scope of the invention, as noted in the appended claims.

I claim:

1. A system for selectively delivering anti-corrosive oil to the interior of an internal combustion engine at user selected occasions, comprising:

a reservoir of anti-corrosion oil, said reservoir having a remotely controlled outlet valve, said outlet valve being in fluid flow communication with a substantially permanently installed spray nozzle located adjacent to an intake of the internal combustion engine, said outlet valve selectively openable to permit fluid flow of the anti-corrosion oil from said reservoir of anti-corrosion oil to said spray nozzle located adjacent to said intake of the internal combustion engine, a means to open said outlet valve, said means comprising a user activated source of force applicable against said outlet valve to permit the anti-corrosive oil to flow therefrom, wherein said reservoir is an aerosol spray can, wherein said means to open said outlet valve comprises a movable member, said movable member responsive to movement by a solenoid, said solenoid controlled by a user activated switch by means of a user activated member, said movable member engagable against said outlet valve upon the application of force there against, to release said anti-corrosive oil through said conduit to the engine intake.

2. The system for selectively delivering anti-corrosive oil as in claim 1, wherein a conduit is provided between said outlet valve and said spray nozzle attachable to said intake of the internal combustion engine.

3. The system for selectively delivering anti-corrosive oil as in claim 2, wherein said spray nozzle is substantially permanently attached to said intake of the internal combustion engine.

4. The system for selectively delivering anti-corrosive oil as in claim 1, wherein a conduit is provided between said outlet valve and said spray nozzle attachable to said intake of the internal combustion engine.

5. The system for selectively delivering anti-corrosive oil as in claim 1, wherein said spray nozzle is substantially permanently attached to said intake of the internal combustion engine.

6. The system for selectively delivering anti-corrosive oil, as in claim 1, wherein said means to open said outlet valve comprises a movable cable between a user operable handle and said outlet valve.

7. The system for selectively delivering anti-corrosive oil, as in claim 1, wherein said internal combustion engine is a marine engine.

8. The system for selectively delivering anti-corrosive oil, as in claim 1, wherein said internal combustion engine is an automobile engine.

9. The system for selectively delivering anti-corrosive oil, as in claim 1, wherein said internal combustion engine is a seasonal use recreational vehicle engine.

10. The system for selectively delivering anti-corrosive oil, as in claim 1, wherein said internal combustion engine sits idle for extended periods of time between consecutive uses of said engine.

11. A system for selectively delivering anti-corrosive oil to the interior of an internal combustion engine at user selected occasions, comprising:

a reservoir of anti-corrosion oil, said reservoir having a remotely controlled outlet valve, said outlet valve in fluid flow communication to a substantially permanently installed spray nozzle located adjacent to an intake of the internal combustion engine, said outlet valve selectively openable to permit fluid flow of the anti-corrosion oil from said reservoir of anti-corrosion oil to said spray nozzle located adjacent to said intake of the internal combustion engine, a means to open said outlet valve, said means comprising a user activated source of force applicable against said outlet valve to permit the anti-corrosive oil to flow therefrom, wherein said reservoir is an aerosol spray can, wherein said means to open said outlet valve comprises a lever movable about a pivot point, said lever responsive to movement by a solenoid, said solenoid controlled by a user activated switch by means of a user activated button, said lever engagable against said outlet valve upon the application of force there against, to release said anti-corrosive oil through said conduit to the engine intake.

12. The system for selectively delivering anti-corrosive oil, as in claim 11, wherein said means to open said outlet valve comprises a movable cable between a user operable handle and said outlet valve.

13. The system for selectively delivering anti-corrosive oil, as in claim 11, wherein said internal combustion engine is a marine engine.

14. The system for selectively delivering anti-corrosive oil, as in claim 11, wherein said internal combustion engine is an automobile engine.

15. The system for selectively delivering anti-corrosive oil, as in claim 11, wherein said internal combustion engine is a seasonal use recreational vehicle engine.

16. The system for selectively delivering anti-corrosive oil, as in claim 11, wherein said internal combustion engine sits idle for extended periods of time between consecutive uses of said engine.

17. A anti-corrosive fogging device for an internal combustion engine which sits idle for extended period of time between consecutive uses of said internal combustion engine, such as a marine engine, an antique motor vehicle, or a seasonal use recreational motor vehicle comprising:

a valve selectively communicating with the intake of the internal combustion engine for injecting oil having anti-corrosive properties into the internal combustion engine, an aerosol spray can connected to a solenoid communicating with said aerosol spray can of anti-corrosive oil, said solenoid remotely controlled by a switch, said aerosol spray can including an outlet valve controlled by a lever, a power supply providing power to said solenoid to selectively dispense said anti-corrosive oil from said aerosol spray can through a hose to said spray nozzle attached to an intake portion of the internal combustion engine, said solenoid supplying force to said lever, said lever movable against an outlet valve of said aerosol spray can, thereby releasing pressure within said aerosol spray can to permit the flow of said anti-corrosive oil through said spray nozzle into said engine intake, said solenoid engagable with said lever to pull said lever downward in the direction of said solenoid, about a pivot point to permit the flow of anti-corrosive oil therethrough, wherein the interior of the cylinders of the engine is treated against corrosion by said pressured flow of said anti-corrosive oil to said engine intake, and said aerosol spray can is attached to a bulkhead wall of the boat.

* * * * *